US007108947B2

(12) United States Patent
Wu et al.

(10) Patent No.: US 7,108,947 B2
(45) **Date of Patent: *Sep. 19, 2006**

(54) SOL-GEL PROCESSES FOR PHOTORECEPTOR LAYERS

(75) Inventors: Jin Wu, Webster, NY (US); Liang-Bih Lin, Webster, NY (US); Anna M. Main, Rochester, NY (US); Linda L. Ferrarese, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 264 days.

This patent is subject to a terminal disclaimer.

(21) Appl. No.: 10/739,212

(22) Filed: Dec. 19, 2003

(65) Prior Publication Data

US 2005/0136348 A1 Jun. 23, 2005

(51) Int. Cl.
*G03G 15/00* (2006.01)

(52) U.S. Cl. ..... 430/56; 430/67

(58) Field of Classification Search ..... 430/56, 430/66, 67

See application file for complete search history.

(56) References Cited

U.S. PATENT DOCUMENTS

| | | | | |
|---|---|---|---|---|
| 3,121,006 | A | 2/1964 | Middleton et al. | |
| 3,357,989 | A | 12/1967 | Byrne et al. | |
| 3,442,781 | A | 5/1969 | Weinberger | |
| 3,871,882 | A | 3/1975 | Wiedemann | |
| 4,233,384 | A | 11/1980 | Turner et al. | |
| 4,265,900 | A | 5/1981 | Rasmussen et al. | |
| 4,299,897 | A | 11/1981 | Stolka et al. | |
| 4,306,008 | A | 12/1981 | Pai et al. | |
| 4,415,639 | A | 11/1983 | Horgan | |
| 4,419,427 | A | 12/1983 | Graser et al. | |
| 4,429,029 | A | 1/1984 | Hoffmann et al. | |
| 4,439,507 | A | 3/1984 | Pan et al. | |
| 4,464,450 | A | 8/1984 | Teuscher | |
| 4,555,463 | A | 11/1985 | Hor et al. | |
| 4,587,189 | A | 5/1986 | Hor et al. | |
| 4,647,521 | A | 3/1987 | Oguchi et al. | |
| 4,664,995 | A | 5/1987 | Horgan et al. | |
| 4,675,262 | A | 6/1987 | Tanaka | |
| 4,678,731 | A | 7/1987 | Yoshizawa et al. | |
| 4,713,308 | A | 12/1987 | Yoshizawa et al. | |
| 4,717,637 | A | 1/1988 | Yoshizawa et al. | |
| 4,784,928 | A | 11/1988 | Kan et al. | |
| 4,869,982 | A | 9/1989 | Murphy | |
| 4,869,988 | A | 9/1989 | Ong et al. | |
| 4,937,164 | A | 6/1990 | Duff et al. | |
| 4,946,754 | A | 8/1990 | Ong et al. | |
| 5,008,167 | A | 4/1991 | Yu | |
| 5,096,795 | A | 3/1992 | Yu | |
| 5,252,654 | A | 10/1993 | David et al. | |
| 5,707,767 | A | 1/1998 | Yu | |
| 5,849,445 | A * | 12/1998 | Visser et al. | 430/57.2 |
| 6,030,735 | A * | 2/2000 | Springett | 430/58.8 |
| 6,265,122 | B1 | 7/2001 | Itami et al. | |
| 6,372,398 | B1 * | 4/2002 | Yamada et al. | 430/66 |
| 6,656,652 | B1 * | 12/2003 | Ishii et al. | 430/59.3 |

OTHER PUBLICATIONS

I.A. David and G.W. Scherer, "An Organic/Inorganic Single-Phase Composite", *Chem. Mater.*, vol. 7, pp. 1957-1967 (1995).

* cited by examiner

*Primary Examiner*—John L Goodrow
(74) *Attorney, Agent, or Firm*—Oliff & Berridge, PLC

(57) ABSTRACT

A photoconductive imaging member includes a hole blocking layer, a photogenerating layer, a charge transport layer, and an optional overcoating layer, wherein at least one of the charge transport layer and the optional overcoating layer is formed in a sol-gel process.

14 Claims, No Drawings

SOL-GEL PROCESSES FOR PHOTORECEPTOR LAYERS

BACKGROUND OF THE INVENTION

1. Field of Invention

This invention relates to sol-gel processes used to form photoreceptor layers, and photoreceptors including such layers. More particularly, the present invention relates to sol-gel processes used to form layers of a photoreceptor structure, particularly charge transfer and overcoat layers, and layers and photoreceptors formed thereby.

2. Description of Related Art

In the art of xerography, also known as electrostatographic or electrophotographic printing, a xerographic plate or drum, known as a photoreceptor or imaging member, comprising a photoconductive insulating layer is imaged by first uniformly depositing an electrostatic charge on the imaging surface of the photoreceptor and then exposing the photoreceptor to a pattern of activating electromagnetic radiation such as light or a laser source, which selectively dissipates the charge in the illuminated areas of the plate while leaving behind an electrostatic latent image in the non-illuminated areas. This electrostatic latent image may then be developed to form a visible image by depositing finely divided electroscopic marking particles or toner particles on the imaging surface.

Generally, layered photoresponsive imaging members are described in a number of U.S. patents, such as U.S. Pat. No. 4,265,900, the entire disclosure of which is incorporated herein by reference, wherein there is illustrated an imaging member comprised of a photogenerating layer, and an aryl amine hole transport layer. For example, charge transport layers comprised of aryl diamines dispersed in polycarbonates, like MAKROLON® are known. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent can comprise resins that are substantially incapable of transporting for any significant distance, injected charge carriers generated by the photoconductive particles.

There are also disclosed in U.S. Patent No.3,871,882 photoconductive substances comprised of specific perylene-3,4,9,10-tetracarboxylic acid derivatives. In accordance with the teachings of this patent, the photoconductive layer is preferably formed by vapor depositing the perylene derivatives in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the entire disclosure of which is incorporated herein by reference, there is illustrated a layered imaging member with a chloroindium phthalocyanine photogenerating layer. In U.S. Pat. No. 4,587,189, the entire disclosure of which is incorporated herein by reference, there is illustrated a layered imaging member with a nonhalogenated perylene pigment photogenerating component. Both of the aforementioned patents disclose an aryl amine component as a hole transport layer and wherein there can be selected a resin binder.

Moreover, there are disclosed in U.S. Pat. No. 4,419,427 electrographic recording media with a photosemiconductive double layer comprised of a first layer containing charge carrier perylene diimide pigments, and a second layer with one or more compounds which are charge transporting materials when exposed to light.

U.S. Pat. No. 4,419,427 discloses the use of highly-loaded dispersions of perylene bisimides, with bis(2,6-dichlorophenylimide) being a preferred material, in binder resins as charge generating layers in devices overcoated with a charge transporting layer such as a poly(vinylcarbazole) composition. U.S. Pat. No. 4,429,029 illustrates the use, in devices similar to those of the '427 patent, of bisimides and bisimidazo perylenes in which the perylene nucleus is halogenated, preferably to an extent where 45 to 75 percent of the perylene ring hydrogens have been replaced by halogen. U.S. Pat. No. 4,587,189, the entire disclosure of which is incorporated herein by reference, illustrates layered photoresponsive imaging members prepared with highly-loaded dispersions or, preferably, vacuum evaporated thin coatings of cis- and trans-bis(benzimidazo)perylene (4a, X=1,2-phenylene) and other perylenes overcoated with hole transporting compositions comprised of a variety of N,N,N',N'-tetraaryl-4,4'-diaminobiphenyls. U.S. Pat. No. 4,937,164 illustrates the use of perylene bisimides and bisimidazo pigments in which the 1,12-and/or 6,7 position of the perylene nucleus is bridged by one or two sulfur atoms wherein the pigments in the charge generating layers are either vacuum evaporated or dispersed in binder resins and a layer of tetraaryl biphenyl hole transporting molecules.

In U.S. Pat. Nos.4,869,988 and 4,946,754, the entire disclosures of which are incorporated herein by reference, there are described layered photoconductive imaging members with transport layers incorporating, for example, biarylyl diarylamines, N,N-bis(biarylyl)anilines, and tris(biarylyl)amines as charge transport compounds. In the above-mentioned patents, there are disclosed improved layered photoconductive imaging members comprised of a supporting substrate, a photogenerating layer optionally dispersed in an inactive resinous binder, and in contact therewith a charge transport layer comprised of the above-mentioned charge transport compounds, or mixtures thereof dispersed in resinous binders.

It is also indicated in the aforementioned patents that there may be selected as resin binders for the charge transport molecules those components as illustrated in U.S. Pat. No. 3,121,006 including polycarbonates, polyesters, epoxy resins, polyvinylcarbazole; and also wherein for the preparation of the charge transport layer with a polycarbonate there is selected methylene chloride as a solvent.

Organic photoreceptors, i.e., photoreceptors that utilize organic compounds in the charge generation and/or transport layers, have recently been used to provide improved performance. Such organic photoreceptors typically provide improved performance in terms of better charge acceptance, wider spectral sensitivity, lower cost, and easier manufacture. However, such organic photoreceptors also generally provide decreased performance in terms of shorter operating life due primarily to increased wear and scratch rates.

SUMMARY OF THE INVENTION

Although imaging members with various charge transport layers, especially hole transport layer materials with hole transport molecules including the aryl amines dispersed in resinous binders such as polycarbonates, have been disclosed in the art, and are suitable for their interided purposes, a need remains for improving imaging members, particularly layered members, with chemically and mechanically robust transport layers. Further, there continues to be a need for layered imaging members wherein the layers are sufficiently adhered to one another to allow the continuous use of such members in repetitive imaging systems without layer separation. A further need resides in the provision of photoconductive imaging members with desirable mechanical characteristics. These and other needs may be accomplished, it is believed, in embodiments of the present invention.

To address the above problems and needs, the present invention provides photoreceptor structures where one or more layers of the photoreceptor, such as charge transfer and overcoat layer, are formed by sol-gel processes.

In embodiments, the present.invention provides a photoconductive imaging member comprising: a hole blocking layer, a photogenerating layer, a charge transport layer, and an optional overcoating layer, wherein at least one of the charge transport layer and the optional overcoating layer is formed in a sol-gel process.

DETAILED DESCRIPTION OF EXEMPLARY EMBODIMENTS

Aspects of the present invention relate to photoconductive imaging members comprised of one or more layers that are formed by a sol-gel process. According to the present invention, the photoconductive imaging members can have any of a variety of layered structures, as are known in the art and as demonstrated in the above-cited references. For example, the photoconductive imaging members can include one or more of the various known layers including, but not limited to, an anti-curl back coating layer, a supporting substrate, a conductive substrate, an electrically conductive ground plane, a blocking layer, an adhesive layer, a charge generating layer, a charge transport layer that can be separate from or combined with the charge generating layer, an overcoat layer, and the like.

The photoconductive imaging members of the present invention can thus be comprised of a supporting substrate, a hole blocking layer, a photogenerator layer, a charge transport layer and optionally an overcoat layer, wherein at least one of the layers such as the charge transport layer or the overcoat layer, is prepared by a sol-gel process. The supporting substrate can be, for example, but is not limited to, a metal, a conductive polymer, or an insulating polymer, each with a thickness of from about 30 microns to about 500 microns. The supporting substrate can also optionally be overcoated with an electrically conductive layer, with an optional thickness of from about 0.01 micron to about 1 micron. If desired, the imaging member can further include an overcoating top layer on the member, which is preferably but not necessarily made by a sol-gel process.

Sol-gel processes are generally known in the art, and can be applied to the present invention based on the known processes and the present disclosure. Accordingly, at least one of the layers of the photoreceptor of the present invention comprises an organic-inorganic composite structure, generally characterized as an inorganic glassy polymer having an organic material dispersed in or interpenetrated into and/or chemically bonded into the inorganic polymer network.

The organic-inorganic composite structure includes a glassy polymer, such as an inorganic silica polymer such as a silica glass structure. The glassy polymer is prepared by a solution-gelation (or "sol-gel") process during which hydrolysis, followed by condensation polymerization, of a silicon alkoxide, such as tetraethylorthosilicate (hereafter "TEOS"), takes place in the presence of water and an alcohol. The general process for forming sol-gels is taught, for example, in C. J. Brinker and G. Scherer, Sol-Gel Science: The Physics and Chemistry of Sol-Gel Processing (Academic Press, Boston, 1990), which is incorporated herein by reference. This two-step reaction process, which transforms a miscible one-phase liquid solution into a two-phase material, is called "sol-gel transition". Generally, the TEOS/water/alcohol mixture is slow to hydrolyze. However, the hydrolysis rate is a function of the solution pH and, therefore, may be controlled by the addition of an acid or base as a catalyst. The reaction mixture can further include other materials, such as organic monomers or polymers or other additives, which can become either chemically bound into the glassy polymer network, or entrapped in the glassy polymer structure. According to the present invention, the glassy polymer network itself does not include any carbon atoms, although carbon atoms can be included in the overall structure, such as in pendant groups.

As is known in the sol-gel art, solution pH may influence the properties of the formed glassy polymer gel. Polymerization in an alkaline solution generally yields a polymer gel that is relatively porous and translucent, and further characterized by clusters of $SiO_2$ that are linked together to form the gel. Polymerization in an acidic solution, on the other hand, generally yields a transparent polymer gel that is characterized by a very fine porosity (i.e., is microporous) and by uniform, linear molecules that coalesce during subsequent sintering to form a high-density (fully dense) material at relatively low temperatures (e.g., about 800° C).

The polymer gel formed by the sol-gel process is a two-phase material, denoted "alcogel," one phase of which contains a solid siloxane skeletal network (i.e., $(—Si—O—Si—)_n$), and an aqueous phase containing water and alcohol in the pores. Once the alcogel is formed, it is dried by slowly heating the gel to vaporize the volatile species, such as alcohol. Drying of the alcogel should occur slowly, because rapid drying may result in non-uniform gel shrinkage, which may then cause cracking in a subsequently dried alcogel (a xerogel). Cracking is especially noticeable in gels having a high liquid content in small pores. In this case, if drying occurs too rapidly, the small pores will not be able to accommodate the expulsion of liquid quickly enough, thereby causing cracks in the resulting xerogel.

By properly driving off the volatile species by natural evaporation, the formed polymer gel comprises a two-phase, rigid xerogel (a gel containing an oxide skeleton and micropores). The number and size of the pores found in the final glass product (and, thus, the density of the final glass product) are a function of the rate of heating, the ultimate sintering temperature, and the period of time the xerogel is maintained at the ultimate sintering temperature.

Although the sol-gel process is discussed above with respect to a silicon-based material, the sol-gel processes and layers of the present invention are not limited to such silicon materials. Rather, in the sol-gel processes of the present invention, any suitable and desirable polymeric oxide structure can be provided. Thus, for example, the resultant inorganic glassy polymer can be formed as oxides of Al, B, Si, Sn, Ti, Zr, or the like. Preferred materials include, but are not limited to, silica, titania, alumina, zirconia, and aluminum phosphate.

As suitable precursor sol-gel materials, any of the known or after-developed desirable materials can be used. For example, known compounds comprising alkoxysilyl or hydroxysilyl groups suitable for use in the present invention include: alkyltrialkoxysilanes, such as, phenyltrimethoxysilane, methyltrimethoxysilane, methyltriethoxysilane, 3-glycidoxypropyltrimethoxysilane, 3-trifluoropropyltrimethoxysilane, methacryloxypropyltriethoxysilane, triethoxysilylisobutyl-POSS (POSS is polyhedral oligomeric silsesquioxane), octa(trichlorosilylethyl)-POSS, and the like; tetraalkoxysilanes, such as, tetramethoxysilane ("TMOS"), tetraethoxysilane ("TEOS") and oligomeric condensates of TEOS such as ethylsilicate 40, tetraisopropoxysilane, tetrapropoxysilane, tetraisobutoxysilane, tetrabutoxysilane, and the like. Other siloxane compounds include, but are not limited to, bis(triethoxysilyl)methane, 1,9-bis(triethoxysilyl)nonane, diethoxydichlorosilane, triethoxychlorosilane, and the like. Other suitable precursor sol-gel materials include, but are not limited to, titanium (IV) isopropoxide, titanium (IV) methoxide, diisopropoxybisethylacetoacetato titanate, triethanolamine titanate, triethanolamine zirconate, aluminum sec-butoxide, and the like.

When conducting the sol-gel process, an acid catalyst is generally used to speed the sol-gel reactions. Suitable acids that can be used include, but are not limited to, inorganic acids such as hydrochloric acid, hydrofluoric acid, sulfiuric acid, nitric acid, and the like; an organic acid such as acetic acid, trifluoroacetic acid, oxalic acid, formic acid, glycolic acid, glyoxylic acid, and the like; or a polymeric acid such as poly(acrylic acid), poly(vinyl chloride-co-vinyl acetate-co-maleic acid), and the like; mixtures thereof, and the like. These acids can be used at varying strengths, and/or can be diluted in water.

To provide the desired coating layer solutions to prepare a photoreceptor according to the claimed invention, suitable additives can also be included in the sol-gel process. Thus, for example, where the sol-gel process is used to prepare a charge transport layer, the sol-gel process can be conducted with suitable organic binder materials and charge transport materials present in the reaction mixture. Likewise, where the sol-gel process is used to prepare an overcoat layer, the sol-gel process can be conducted with suitable organic binder materials and other conventional additives present in the reaction mixture. When these additional materials are included in the reaction mixture, they typically do not become bound into the glassy polymer structure itself, but instead either become homogeneously dispersed or interpenetrated in the polymer, either as pendant groups or as intertwined materials.

According to the present invention, the photoreceptor layers, where formed by the sol-gel process including hydrolysis and condensation, are preferably formed in situ. That is, the various sol-gel reaction components and other layer material additives can be pre-mixed, allowing hydrolysis of the various sol-gel components in situ in the coating solution, and then it is preferred that condenstation of the sol-gel reaction or process itself is not conducted until the time of in situ forming including coating and thermal drying the photoreceptor layer. Thus, it is preferred that the various sol-gel reaction components and other layer material additives are applied together as a layer coating, and then the sol-gel reaction is allowed to proceed to form the end-product layer. However, in embodiments if desired, the sol-gel reaction can be conducted in advance of coating the materials onto a substrate to form a photoreceptor layer.

Generally, the photoreceptors of the present invention can include any of the various layers commonly used in photoreceptor design, discussed above. Thus, according to embodiments of the present invention, an electrophotographic imaging member is provided, which generally comprises at least a substrate layer, a hole blocking layer, a charge generating layer, a charge transport layer, and an optional overcoating layer. The hole blocking layer, the charge generating layer and the charge transport layer can, in embodiments, be combined in a single layer. This imaging member can be employed in an imaging process comprising providing the electrophotographic imaging member, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps. These imaging members may be fabricated by any of the various known methods.

In general, electrostatographic imaging members are well known in the art. An electrostatographic imaging member, including the electrostatographic imaging member of the present invention, may be prepared by any of the various suitable techniques, provided that the material being applied as the charge transport or external layer includes the surface energy reducing, hole transporting polymer additive of the present invention. Suitable conventional photoreceptor designs that can be modified in accordance with the present invention include, but are not limited to, those described for example in U.S. Pat. Nos. 4,647,521, 4,664,995, 4,675,262, 4,678,731, 4,713,308, 4,717,637, 4,784,928, 4,869,982, 5,008,167, 5,096,795, and 5,707,767, the entire disclosures of which are incorporated herein by reference.

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resin binders known for this purpose including polyesters, polycarbonates such as bisphenol polycarbonates, polyamides, polyurethanes, polystyrenes and the like. The electrically insulating or conductive substrate may be rigid or flexible and may have any number of different configurations such as, for example, a cylinder, a sheet, a scroll, an endless flexible belt, and the like.

The thickness of the substrate depends on numerous factors, including beam strength and economical considerations. For a flexible belt, the layer may be of substantial thickness, for example, preferably about 125 micrometers, or of a preferred minimum thickness of no less than 50 micrometers, provided there are no adverse effects on the final photoreceptor. In flexible belt embodiments, the thickness of this layer preferably ranges from about 65 micrometers to about 150 micrometers, and most preferably from about 75 micrometers to about 100 micrometers for optimum flexibility and minimum stretch when cycled around small diameter rollers, e.g. 19 millimeter diameter rollers.

The surface of the supporting substrate may comprise an electrically conductive material that extends through the thickness of the substrate or may comprise a layer or coating of electrically conducting material on a self supporting material. The conductive layer may vary in thickness over substantially wide ranges depending on the degree of optical transparency and flexibility desired for the photoreceptor. Accordingly, for a flexible photoreceptor, the thickness of the conductive layer may preferably be between about 20 angstroms to about 750 angstroms, and more preferably from about 100 angstroms to about 200 angstroms for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, vanadium, titanium, nickel, chromium, and the like. If desired, an alloy of suitable metals may be deposited. Typical metal alloys may contain two or more metals such as zirconium, vanadium, titanium, nickel, stainless steel, chromium, and the like, and mixtures thereof. The conductive layer need not be limited to metals.

A hole blocking layer may be applied to the conductive surface of the substrate. Generally, electron blocking layers for positively charged photoreceptors allow holes from the imaging surface of the photoreceptor to migrate toward the conductive layer. Some materials can form a layer that functions as both an adhesive layer and charge blocking layer. Typical blocking layers include polyvinylbutyral, organosilanes, epoxy resins; polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because its cyclic stability is extended. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxy-silane, N-2-aminoethyl-3-arninopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxy-silane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxysilane, trimethoxysilylpropyldiethylenetriamine and mixtures thereof.

Generally, satisfactory results may be achieved when the reaction product of a hydrolyzed silane and metal oxide layer forms a blocking layer having a thickness between about 20 Angstroms and about 2,000 Angstroms.

A preferred hole blocking layer comprises a reaction product between a hydrolyzed silane and the oxidized surface of a metal ground plane layer. The oxidized surface inherently forms on the outer surface of most metal ground plane layers when exposed to air after vacuum deposition. The hole blocking layer may be applied by any suitable conventional technique such as spraying, dip coating, draw bar coating, gravure coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The hole blocking layer should be continuous and preferably have a thickness of less than about 0.2 micrometer after drying because greater thicknesses may lead to undesirably high residual voltage.

The hole blocking layer can also be particulate, in which pigment particles are dispersed in a polymeric binder. The pigments include, but are not limited to, titanium dioxide, zinc oxide, tin oxide and other metal oxides. The polymeric binder can include but is not limited to, for example, phenolic resin, poly(vinyl butyral), polyamide and other polymers. The pigment/binder weight/weight ratio varies from about 30/70 to about 80/20. The thickness of the blocking layer varies from about 1 μm to about 30μm.

An optional adhesive layer may be applied to the blocking layer. Any suitable adhesive layer well known in the art may be utilized. Typical adhesive layer materials include, for example, polyesters, DuPont 49,000 (available from E. I. DuPont de Nemours and Company), Vitel PE100 (available from Goodyear Tire & Rubber), polyurethanes, and the like. Satisfactory results may be achieved with a preferred adhesive layer thickness between about 0.05 micrometer (500 angstroms) and about 0.3 micrometer (3,000 angstroms). Conventional techniques for applying an adhesive layer coating mixture over the hole blocking layer include spraying, dip coating, extrusion coating, roll coating, wire wound rod coating, gravure coating, Bird applicator coating, and the like. Drying of the deposited coating may be effected by any suitable conventional technique such as oven drying, infra-red radiation drying, air impingement drying, vacuum drying and the like.

Any suitable photogenerating layer may be applied to the optional adhesive layer, which can then be overcoated with a contiguous hole transport layer as described hereinafter or these layers may be applied in reverse order. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium dyes, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder.

Multi-photogenerating layer compositions may be utilized where a photoconductive layer enhances or reduces the properties of the photogenerating layer. Examples. of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidene chloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material preferably ranges in thickness of from about 0.1 micrometer to about 5.0 micrometers, and most preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, extrusion coating, and the like. Drying of the deposited coating may be effected by any suitable conventional technique such as oven drying, infra-red radiation drying, air impingement drying, vacuum drying and the like.

An active charge transport layer may comprise an activating compound useful as an additive dispersed in electrically inactive polymeric materials making these materials electrically active. These compounds may be added to polymeric materials, which are incapable of supporting the injection of photogenerated holes from the generation material and incapable of allowing the transport of these holes there through. This will convert the electrically inactive polymeric material to a material capable of supporting the injection of photogenerated holes from the generation material and capable of allowing the transport of these holes through the active layer in order to discharge the surface charge on the active layer. An especially preferred transport layer that may be employed in multilayered photoconductors of this invention, comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

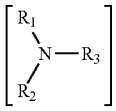

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to about 18 carbon atoms and cycloaliphatic compounds having from about 3 to about 18 carbon atoms. The substituents should preferably be free from electron withdrawing groups such as $NO_2$ groups, CN groups, and the like.

Examples of charge transporting aromatic amines represented by the structural formula above for charge transport layers capable of supporting the injection of photogenerated holes of a charge generating layer and transporting the holes through the charge transport layer include bis(4-diethylamino-2-methyl-phenyl)phenyl-methane, 4'-4-bis(diethylamino)-2',2-dimethytriphenylmethane, N,N,'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, N,N'-diphenyl-N,N'-bis(3-hydroxphenyl)-(1,1'-biphenyl)-4,4'-diamine, tritolyl amine, N,N-bis(3,4-dimethylphenyl)-1-aminobiphenyl, and the like dispersed in an inactive resin binder.

Any suitable inactive resin binder may be employed in the photoreceptors of this invention. Typical inactive resin binders include polycarbonate resin, polyether carbonate, polyester, polyarylate, polyacrylate, polyether, polysulfone, and the like. Weight average molecular weights can vary from about 20,000 to about 150,000.

Any suitable and conventional technique may be utilized to mix and thereafter apply the charge transport layer coating mixture to the charge generating layer. Typical application techniques include spraying, extrusion coating, dip coating, roll coating, wire wound rod coating, and the like. Drying of the deposited coating may be effected by any suitable conventional technique such as oven drying, infrared radiation drying, air impingement drying and the like. However, to provide the improved results of the claimed invention, the charge transport layer coating mixture is applied to the charge generating layer by coating the mixture onto the charge generating layer, and allowing the sol-gel process to proceed to provide a cross-linked glassy polymer structure containing the charge transport layer components.

Preferably, the thickness of the transport layer is between about 10 to about 50 micrometers, but thicknesses outside this range can also be used. The transport layer should be an insulator to the extent that the electrostatic charge placed on the transport layer is not conducted in the absence of illumination at a rate sufficient to prevent formation and retention of an electrostatic latent image thereon. In general, the ratio of the thickness of the transport layer to the charge generator layer is preferably from about 2:1 to 200:1 and in some instances as great as about 400:1.

The preferred electrically inactive resin materials are polycarbonate resins having a weight average molecular weight from about 20,000 to about 150,000, more preferably from about 50,000 to about 120,000. The materials most preferred as the electrically inactive resin material is poly (4,4'-isopropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company poly (4,4'-cyclohexylidene diphenyl carbonate) (polycarbonate Z), poly(4,4'-isopropylidene-3,3'-dimethyl-diphenyl-carbonate); poly(4,4'-diphenyl-methyl phenyl-carbonate); and the like. Methylene chloride or monochlorobenzene or tetrahydrofuran (THF) solvent is a preferred component of the charge transport layer coating mixture for adequate dissolving of all the components.

Examples of photosensitive members having at least two electrically operative layers include the charge generator layer and diamine containing transport layer members disclosed in U.S. Pat. Nos. 4,265,990, 4,233,384; 4,306,008, 4,299,897 and 4,439,507, the entire disclosures of which are incorporated herein by reference. The photoreceptors may comprise, for example, a charge generator layer sandwiched between a conductive surface and a charge transport layer as described above or a charge transport layer sandwiched between a conductive surface and a charge generator layer.

An especially preferred multilayered photoconductor comprises a charge generating layer comprising a photoconductive material and a contiguous transport layer of a film forming binder and an electrically active small molecule. A preferred transport layer comprises a polycarbonate resin material having a molecular weight of from about 20,000 to about 120,000 and having dispersed therein from about 25 to about 75 percent by weight of one or more compounds having the general formula:

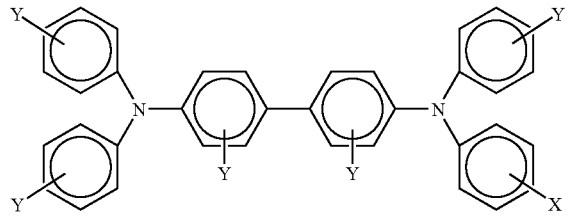

wherein X is an alkyl group, having from 1 to about 4 carbon atoms, and Y is H or an alkyl group having 1–4 carbon atoms.

In multilayered photoreceptors, the photoconductive charge generating layer should exhibit the capability of photogeneration of holes and injection of the holes, the charge transport layer being substantially non-absorbing in the spectral region at which the photoconductive layer generates and injects photogenerated holes but being capable of supporting the injection of photogenerated holes from the photoconductive layer and transporting the holes through the transport layer. If the photoconductive layer or charge generating layer is the outer layer in the imaging member of this invention, it can contain the surface energy reducing, hole transporting polymer additive of this invention.

Other layers such as a conventional electrically conductive ground strip can be located adjacent to the charge transport layer along one edge of the belt in contact with the conductive layer, blocking layer, adhesive layer or charge generating layer to facilitate connection of the electrically conductive layer of the photoreceptor to ground or to an electrical bias. The ground strip layer comprises a film forming polymer binder and electrically conductive particles. Any suitable electrically conductive particles may be used in the electrically conductive ground strip layer. For example, the ground strip may comprise materials that include those enumerated in U.S. Pat. No. 4,664,995, the disclosure thereof being incorporated herein in its entirety. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized. The ground strip layer may preferably have a thickness from about 7 micrometers to about 42 micrometers, and most preferably from about 14 micrometers to about 27 micrometers. However, not all photoreceptors utilize a ground strip. If a ground strip is present, it may be present as an outer layer along with and adjacent to other outer layers that may be a film forming polymer containing charge generating layer, charge transport layer, overcoating layer or dielectric layer.

If an overcoat layer comprising a film forming polymer binder is employed, it will be an outer layer in which the surface energy reducing, hole transporting polymer additive may be added. Overcoatings without a surface energy reducing, hole transporting polymer additive are well known in the art and are either electrically insulating or slightly hole transporting. When overcoatings are employed on the photoreceptor of this invention, it should be continuous. The overcoating layer may preferably range in thickness from about 2 micrometers to about 8 micrometers, and more preferably from about 3 micrometers to about 6 micrometers. An optimum range of thickness is from about 3 micrometers to about 5 micrometers.

Any suitable and conventional technique may be utilized to mix and thereafter apply the overcoating layer coating mixture to the underlying layer, such as a charge transport layer. Typical application techniques include spraying, extrusion coating, dip coating, roll coating, wire wound rod coating, and the like. Drying of the deposited coating may be effected by any suitable conventional technique such as oven drying, infrared radiation drying, air impingement drying and the like. However, to provide the improved results of the claimed invention, the overcoating layer coating mixture is applied to the underlying layer by coating the mixture onto the layer, and allowing the sol-gel process to proceed to provide a cross-linked glassy polymer structure containing the overcoating layer components.

In some cases an anti-curl back coating may optionally be applied to the side opposite the imaging side of the photoreceptor to enhance flatness and/or abrasion resistance. The anti-curl back coating layers are well known in the art and may comprise film forming polymers, examples of which are polyacrylates, polystyrene, poly(4,4'-isopropylidene diphenyl carbonate), 4,4'-cyclohexylidene diphenyl polycarbonate, and the like. An adhesion promoter additive may also be used. Usually from about 1 to about 15 weight percent of adhesion promoter is added to the anti-curl back layer. Typical adhesion promoter additives include 49,000 (available from E. I. DuPont de Nemours & Co.), Vitel PE-100, Vitel PE-200, Vitel PE-307 (Goodyear Chemical), and the like. The thickness of the anti-curl layer is preferably between about 3 micrometers and about 35 micrometers.

The present invention also encompasses imaging and printing devices and methods for generating images with the photoconductive imaging members disclosed herein. The method comprises the steps of generating an electrostatic latent image on a photoconductive imaging member of the present invention, developing the latent image with a toner comprised of resin, colorant like carbon black, and a charge additive, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate, such as paper, may be by any method, including those making use of a corotron or a biased roll. The fixing step may be performed by means of any suitable method, such as flash fusing, heat fusing, pressure fusing, vapor fusing, and the like. Any substrate selected for xerographic copiers and printers, including digital copiers, may be used as a substrate, such as paper, transparency, and the like.

The present invention discloses application of sol-gel technology to form outer layers (such as charge transport layers and/or overcoating layers) of photoreceptors. Such sol-gel methods for applying the photoreceptor layers have been unexpectedly found to provide improved wear resistance. Conventional approaches for wear resistance improvement are dispersing either hard inert particles )such as silica, aluminum oxide, and titanium oxide) and/or low surface energy particles (such as polytetrafluoroethylene (PTFE) microparticle) into the charge transport layer or overcoating layer. However, the dispersion is very difficult to prepare and the pot life is short. In addition, the adhesions between particles and photoreceptor layers are weak, due primarily to small contact areas.

In this invention, sol-gel reaction components are mixed with conventional photoreceptor layer materials. The hydrolysis of the sol-gel reaction components takes place in situ in the coating solution. No dispersion is involved, and the preparation is simple and the obtained homogeneous solution has longer pot life. After coating, solvents used in the process evaporate, and a desired thin film forms. The condensation of the sol-gel reaction components takes place in situ during thermal drying, and an organic-inorganic interpenetrating network is formed, which unexpectedly provides better wear resistance, deletion control and other benefits. The surface energy of the outer layer can be lowered for improved wear resistance with selection of fluorinated sol-gel reaction components such as trifluoropropyltrimethoxysilane.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLES

Example 1

An illustrative photoresponsive imaging device of the present invention is fabricated as follows.

A hole blocking layer is fabricated from a coating dispersion consisting of titanium dioxide ($TiO_2$ STR-60N, Sakai), silica (P-100, Esprit) and phenolic resin (Varcum 29159, OxyChem) in xylene/1-butanol (wt/wt=50/50). The weight ratio of titanium dioxide, silica, phenolic resin is 52/10/38. An aluminum drum substrate of 30 mm in diameter is dip-coated from a dip-coating tank containing the coating solution and dried at a temperature of 145° C. for 45 minutes. The resulting dry blocking layer has a thickness of about 4.0 micrometers. A charge generator coating dispersion is prepared by dispersing 15 grams of chlorogallium phthalocyanine particles in a solution of 10 grams VMCH (available from Union Carbide Co.) in 368 grams of 2:1 mixture of xylene and n-butyl acetate by weight. This dispersion is milled in a Dynomill mill (KDL, available from GlenMill) with 0.4-micrometer zirconium balls for 4 hours. The drum with the hole blocking layer then is dip-coated with the charge generator coating dispersion. The resulting coated drum is air dried to form a 0.2~0.5-micrometer thick charge generating layer.

A charge transport layer coating solution is prepared by mixing poly(4,4'-diphenyl-1,1'-cyclohexane carbonate) (PCZ400, available from Mitsubishi Gas Chemical Company, Inc.) binder, N,N'-diphenyl-N,N'-bis(3-methylphenyl)-[1,1'-biphenyl]-4,4'-diamine, and 2,6-di-t-butyl-4-methylphenol (BHT, an antioxidant inhibitor), all in a weight ratio of 60:40:1 in a mixed solvent of tetrahydrofuran (THF) and toluene, in a weight ratio of 70:30. The solids content is about 22-wt %. 20 grams of tetraethoxysilane (TEOS) is added to 400 grams of the prepared charge transport layer coating solution. Water acidified with hydrochloric acid (HCl) is added as a sol-gel catalyst. The molar ratios of water to TEOS and HCl to TEOS are 5:1 and 0.05:1, respectively. The solution is roll mixed for 24 hours, resulting in a homogeneous mixture with no dispersion stability concerns. The thus-prepared organic-inorganic charge transport coating solution is applied onto the coated drum by ring coating with a Tsukiage coater. The coated drum is dried and cured at 120° C. for 1 hour to form a 24-micrometer thick charge transport layer.

For comparison, a reference imaging device is prepared in the same manner except that the tetraethoxysilane (TEOS) and acidified water are omitted.

The xerographic electrical properties of the imaging member are determined by electrostatically charging its surface with a corona discharging device in the dark until the surface potential, as measured by a capacitively coupled probe attached to an electrometer, attains an initial value ($V_o$) of about 500 volts. After resting for 0.5 second in the dark, the charged member reaches a certain surface potential referred to as dark development potential ($V_{ddp}$), and is then exposed to light from a filtered xenon lamp. A reduction in the surface potential to a background potential ($V_{bg}$) due to photodischarge effect is observed. The dark decay in volt/ second is calculated as $(V_o-V_{ddp})/0.5$. The percent photodischarge is calculated as $100\%\times(V_{ddp}-V_{bg})/V_{ddp}$. The light energy used to photodischarge the imaging member during the exposure step is measured with a light meter. The photosensitivity of the imaging member can be described in terms of $E_{1/2}$, amount of exposure energy in erg/cm$^2$ required to achieve 50 percent photodischarge from the dark development potential. The higher the photosensitivity, the smaller the $E_{1/2}$ value. High charge acceptance, low dark decay, and high photosensitivity (lower $E_{1/2}$ value) are desired for the improved performance of xerographic imaging members.

The following table summarizes the electrical and wear test results of the experimental imaging device. The exposure light used is at a wavelength of 670 nanometers.

| Device | Vdepl | DiThk | dV/dx | V(4.26) | Dark Decay | Wear Rate[a] |
|---|---|---|---|---|---|---|
| Control Device | 10 | 7.8 | −140 | 160 | 12 | 80 |
| Device with Sol-Gel charge transport layer | 7 | 7.5 | −136 | 168 | 8 | 65 |

[a]unites are nm/1000 cycles

These results indicate that the photoreceptor of the present invention, with a sol-gel applied charge transport layer, provides comparable results to a conventional dip-coated charge transport layer. However, analysis shows that the sol-gel applied layer provides lowered wear rate, increased hardness, compressive strength, heat distortion temperature, and plateau response, and a lower thermal expansion coefficient.

Example 2

A second illustrative photoresponsive imaging device of the present invention is fabricated as follows.

Three photoreceptors are prepared according to the control device of Example 1, above. As fabricated, each photoreceptor includes an aluminum drum, a hole blocking layer, a charge generating layer, and a charge transport layer.

An overcoating layer solution is prepared by mixing 60 grams of Aquazol 50 (poly(ethyl oxazoline), M.W.=50,000, Polymer Chemistry Innovations, Inc.) and 40 grams N,N'-diphenyl-N,N'-bis(3-hydroxphenyl)-(1,1'-biphenyl)-4,4'-diamine in 400 grams absolute ethyl alcohol. 20 grams of tetraethoxysilane (TEOS) is added along with water acidified with hydrochloric acid (HCl) as a sol-gel catalyst. The molar ratios of water to TEOS and HCl to TEOS are 5:1 and 0.05: 1, respectively. The solution is roll mixed for 24 hours, resulting in a homogeneous mixture with no dispersion stability concerns.

To one of the sample photoreceptor devices is applied the thus-prepared organic-inorganic overcoating layer solution by Tsukiage coating to a target thickness of 4 microns. The coated drum is baked at 120° C. for 1 hour. The dimensions of the three devices are as follows:

| Device | Overcoating layer present? | CTL + OCL Thickness (μm) |
|---|---|---|
| Control 1 | No | 24.1 + 0 |
| Control 2 | No | 20.8 + 0 |
| Example 2 | Yes | 21.0 + 4.0 |

The xerographic electrical properties of the imaging member are determined by electrostatically charging its surface with a corona discharging device in the dark until the surface potential, as measured by a capacitively coupled probe attached to an electrometer, attains an initial value ($V_o$) of about 500 volts. After resting for 0.5 second in the dark, the charged member reaches a certain surface potential referred to as dark development potential ($V_{ddp}$), and is then exposed to light from a filtered xenon lamp. A reduction in the surface potential to a background potential ($V_{bg}$) due to photodischarge effect is observed. The dark decay in volt/second is calculated as $(V_o-V_{ddp})/0.5$. The percent photodischarge is calculated as $100\% \times(V_{ddp}-V_{bg})/V_{ddp}$. The light energy used to photodischarge the imaging member during the exposure step is measured with a light meter. The photosensitivity of the imaging member can be described in terms of $E_{1/2}$, amount of exposure energy in erg/cm$^2$ required to achieve 50 percent photodischarge from the dark development potential. The higher the photosensitivity, the smaller the $E_{1/2}$ value. High charge acceptance, low dark decay, and high photosensitivity (lower $E_{1/2}$ value) are desired for the improved performance of xerographic imaging members.

The following table summarizes the electrical and wear test results of the experimental imaging device. The exposure light used is at a wavelength of 670 nanometers.

| Device | Vdepl | DiThk | V(0) | V(4.26) | dV/dx | Verase | Dark decay |
|---|---|---|---|---|---|---|---|
| Control 1 | 9 | 8.1 | 509 | 108 | −159 | 43 | 7 |
| Control 2 | 7 | 6.8 | 501 | 109 | −144 | 38 | 7 |
| Device with Sol-Gel over-coating layer | 23 | 7.2 | 494 | 105 | −149 | 42 | 7 |

These results indicate that the photoreceptor of the present invention, with a sol-gel applied overcoating layer, provides comparable results to a conventional photoreceptor not having an overcoating layer. That is, the overcoated device provides comparable electrical results, but provides extra wear protection to the device.

While this invention has been described in conjunction with various exemplary embodiments, it is to be understood that many alternatives, modifications and variations would be apparent to those skilled in the art. Accordingly, Applicants intend to embrace all such alternatives, modifications and variations that follow in the spirit and scope of this invention.

What is claimed is:

1. A photoconductive imaging member comprising:

a hole blocking layer;

a photogenerating layer;

a charge transport layer; and an overcoating layer;

wherein at least one of the charge transport layer and the overcoating layer is formed in a sol-gel process and wherein said at least one layer comprises organic compounds interpenetrated into an inorganic glassy polymer structure, wherein said overcoating layer is formed by said sol-gel process.

2. The photoconductive imaging member of claim 1, wherein said charge transport layer is formed by said sol-gel process.

3. The photoconductive imaging member of claim 1, wherein both said overcoating layer and said charge transport layer are formed by said sol-gel process.

4. The photoconductive imaging member of claim 1, wherein said at least one layer comprises an inorganic glassy polymer structure formed from oxides selected from the group consisting of aluminum oxides, boron oxides, silicon oxides, tin oxides, titanium oxides, zirconium oxides, and mixtures thereof.

5. The photoconductive imaging member of claim 1, wherein said at least one layer comprises an inorganic glassy polymer structure formed from oxides selected from the group consisting of silica, titania, alumina, zirconia, and aluminum phosphate.

6. The photoconductive imaging member of claim 1, wherein said at least one layer is formed in a sol-gel process from a sol-gel precursor material selected from the group consisting of phenyltrimethoxysilane, methyltrimethoxysilane, methyltriethoxysilane, 3-glycidoxypropyltrimethoxysilane, 3-trifluoropropyltrimethoxysilane, methacryloxypropyltriethoxysilane, triethoxysilylisobutyl-polyhedral oligomeric silsesquioxane, octa(trichlorosilylethyl)-polyhedral oligomeric silsesquioxane, tetramethoxysilane, tetraethoxysilane, oligomeric condensates of tetraethoxysilane, tetraisopropoxysilane, tetrapropoxysilane, tetraisobutoxysilane, tetrabutoxysilane, bis(triethoxysilyl)methane, 1,9-bis(triethoxysilyl)nonane, diethoxydichlorosilane, triethoxychlorosilane, titanium (IV) isopropoxide, titanium (IV) methoxide, diisopropoxybisethylacetoacetato titanate, triethanolamine titanate, triethanolamine zirconate, aluminum sec-butoxide, and mixtures thereof.

7. A method of forming a photoconductive imaging member, comprising:

applying a hole blocking layer to a substrate;

applying a photogenerating layer over said hole blocking layer;

applying a charge transport layer over said photogenerating layer; and applying an overcoating layer over said charge transport layer;

wherein at least one of the charge transport layer and the overcoating layer is formed in a sol-gel process and wherein said at least one layer comprises organic compounds interpenetrated into an inorganic glassy polymer structure, wherein said overcoating layer is formed by said sol-gel process.

8. The method according to claim 7, wherein said charge transport layer is formed by said sol-gel process.

9. The method according to claim 7, wherein both said overcoating layer and said charge transport layer are formed by said sol-gel process.

10. The method according to claim 7, wherein said at least one layer comprises an inorganic glassy polymer structure formed from oxides selected from the group consisting of aluminum oxides, boron oxides, silicon oxides, tin oxides, titanium oxides, zirconium oxides, and mixtures thereof.

11. The method according to claim 7, wherein said at least one layer comprises an inorganic glassy polymer structure formed from oxides selected from the group consisting of silica, titania, alumina, zirconia, and aluminum phosphate.

12. The method according to claim 7, wherein said sol-gel process is conducted in situ in forming said at least one layer.

13. The method according to claim 7, wherein said sol-gel process comprises a sol-gel precursor material selected from the group consisting of phenyltrimethoxysilane, methyltrimethoxysilane, methyltriethoxysilane, 3-glycidoxypropyltrimethoxysilane, 3-trifluoropropyltrimethoxysilane, methacryloxypropyltriethoxysilane, triethoxysilylisobutyl-polyhedral oligomeric silsesquioxane, octa (trichlorosilylethyl)-polyhedral oligomeric silsesquioxane, tetramethoxysilane, tetraethoxysilane, oligomeric condensates of tetraethoxysilane, tetraisopropoxysilane, tetrapropoxysilane, tetraisobutoxysilane, tetrabutoxysilane, bis (triethoxysilyl)methane, 1,9-bis(triethoxysilyl)nonane, diethoxydichlorosilane, triethoxychlorosilane, titanium (IV) isopropoxide, titanium (IV) methoxide, diisopropoxybisethylacetoacetato titanate, triethanolamine titanate, triethanolamine zirconate, aluminum sec-butoxide, and mixtures thereof.

14. The method according to claim 7, wherein said sol-gel process comprises an acid catalyst selected from the group consisting of hydrochloric acid, hydrofluoric acid, sulfuric acid, nitric acid, acetic acid, trifluoroacetic acid, oxalic acid, formic acid, glycolic acid, glyoxylic acid, poly(acrylic acid), poly(vinyl chloride-co-vinyl acetate-co-maleic acid), and mixtures thereof.

* * * * *